United States Patent [19]

Vaughn

[11] 4,191,038

[45] Mar. 4, 1980

[54] KEY HOLDER

[76] Inventor: Randy L. Vaughn, 1079 Fabry Rd., Salem, Oreg. 97302

[21] Appl. No.: 942,640

[22] Filed: Sep. 15, 1978

[51] Int. Cl.[2] ..... A47G 29/10

[52] U.S. Cl. ..... 70/457; 70/458

[58] Field of Search ..... 70/457, 458, 459, 456 R; 24/3 K, 237, 261 R

[56] References Cited

U.S. PATENT DOCUMENTS

| | | | |
|---|---|---|---|
| 295,752 | 3/1884 | Harvey | 70/457 |
| 2,209,475 | 7/1940 | Rawlings | 24/237 |

FOREIGN PATENT DOCUMENTS

| | | | |
|---|---|---|---|
| 383468 | 1/1908 | France | 70/458 |

*Primary Examiner*—Robert L. Wolfe

*Attorney, Agent, or Firm*—Klarquist, Sparkman, Campbell, Leigh, Hall & Whinston

[57] ABSTRACT

A key holder comprises an elongate, resilient member adapted to receive thereon a plurality of keys which have respective member receiving apertures in their heads. The member is configured to provide a coiled intermediate portion and a pair of leg portions which extend therefrom at an acute angle. The ends of the leg portions remote from the intermediate portion are configured to provide means for releasably clasping the leg portions together when the same are compressed toward each other by the hand of a user. The overlying sections of the intermediate portion contact each other adjacent one leg portion and diverge from each other toward the other leg portion. Sliding of a key from a segment of the intermediate portion is substantially inhibited without manual aid and a key can slide relatively freely on the overlying sections over a majority of their lengths. This permits the user to isolate one key from the other keys so that the key can be more conveniently used.

10 Claims, 3 Drawing Figures

KEY HOLDER

BACKGROUND OF THE INVENTION

The present invention relates generally to key holders, and more particularly to a key holder for holding a plurality of keys and formed so that a selected key may be isolated from the other keys.

A wide variety of key holders and key chains have been known heretofore. Typically, they represent attempts to provide a device which will allow for easy attachment and detachment of keys while substantially eliminating the possibility of accidental loss of keys. One disadvantage of many of these key holders is that they have clasps which can inadvertently release or break after repeated use. Another disadvantage of many of these key holders is that they are often made of multiple parts and they are more likely to release or break than a key holder of unitary construction. Yet another disadvantage of many of these key holders is that they do not provide a convenient mechanism for segregating one or more keys from the others so that the keys can be more conveniently used.

SUMMARY OF THE INVENTION

It is a principal object of the present invention to provide a key holder for retaining a plurality of keys which permits the user to isolate a selected key from the other keys so that the key may be more conveniently used.

It is a further object of the present invention to provide a key holder of simple, durable construction which will allow for easy attachment and detachment of keys while substantially eliminating the possibility of accidental loss of keys.

These, as well as other objects and advantages, are achieved by the present invention, a preferred embodiment of which is illustrated herein. The preferred embodiment comprises an elongate, resilient member adapted to receive thereon a plurality of keys which have member receiving apertures in their heads. The member is configured to provide a coiled intermediate portion and a pair of leg portions. The intermediate portion is coiled through more than one revolution so as to have overlying sections. In the illustrated embodiment the leg portions extend from the intermediate portion at an acute angle relative to each other so that they can be readily grasped by a single hand of a user and compressed toward each other. The ends of the leg portions remote from the intermediate portion are configured to provide means for releasably clasping the leg portions together when the same are compressed.

The overlying sections of the intermediate portion contact each other adjacent one leg portion and diverge from each other toward the other leg portion. Sliding of a key from a segment of the intermediate portion is substantially inhibited without manual aid and a key can slide relatively freely on the overlying sections over a majority of their lengths. This permits the user to isolate one key from the other keys on the holder.

DESCRIPTION OF THE PREFERRED EMBODIMENT

Figure 1:
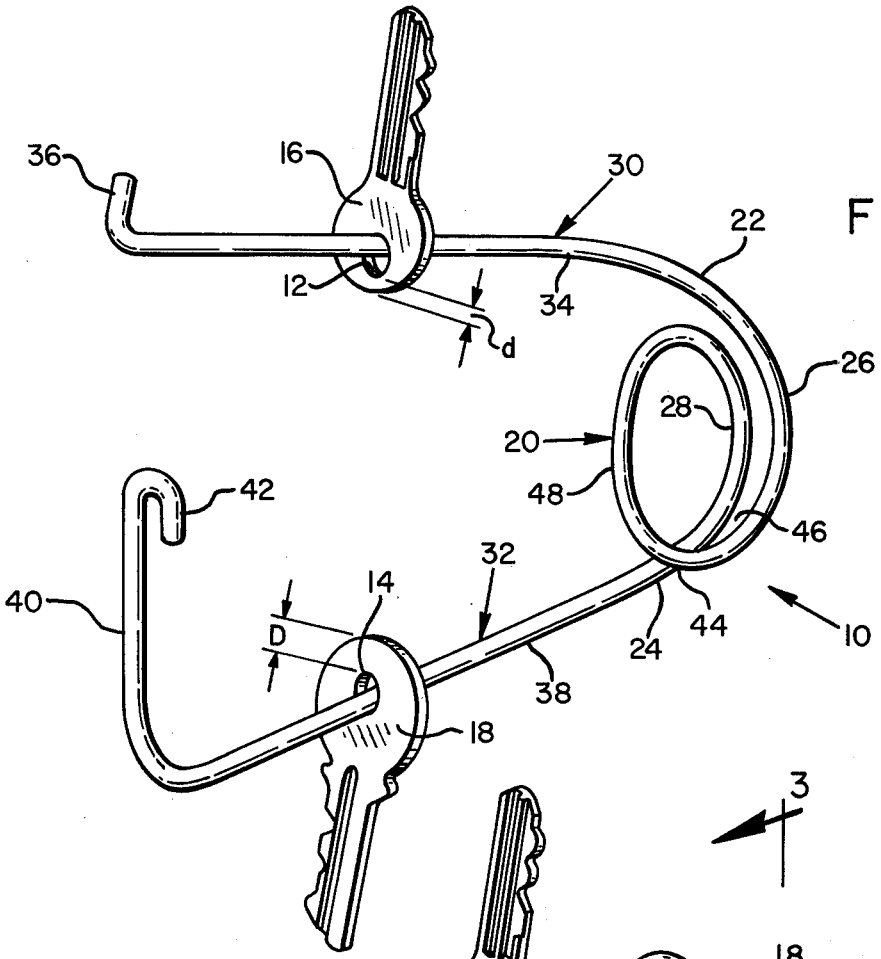
FIG. 1 shows the preferred embodiment of the key holder of the present invention in its unclasped state with a key on each leg portion.

Referring to FIG. 1, the preferred embodiment of the key holder of the present invention comprises an elongate member 10 formed into the configuration shown. The member 10 is preferably made of a resilient material such as round brass or steel wire which can be bent into the desired configuration. The member 10 has a cross section which is sufficiently small so that the member will slide through the respective apertures 12 and 14 in the heads of a plurality of standard keys 16 and 18. The member 10 preferably has a round cross section and a smooth surface to facilitate the sliding of the keys thereon.

In the case of a typical standard key, the minimum distance between its aperture and a point on the periphery of its head will be the distance from the aperture to the top of the head, i.e., to a point on the periphery of the head directly opposite from the shank of the key. In the case of a plurality of standard keys, their apertures will be spaced from the tops of their heads a predetermined minimum distance and a predetermined maximum distance. In the case of the keys 16 and 18, these distances are shown as d and D, respectively.

The member 10 is configured to provide an intermediate coiled portion 20 which begins at about a point 22 and ends at about a point 24. The intermediate portion 20 is preferably coiled through more than one and one-quarter revolutions but preferably less than one and one-half revolutions so as to have adjacent sections 26 and 28. Preferably, the sections 26 and 28 are overlying throughout their lengths, i.e., one section lies directly above the other, although the desired result may also be achieved if the sections are somewhat laterally offset.

A first leg portion 30 and a second leg portion 32 extend from the intermediate portion 20 at an acute angle which is sufficiently small so that they can be grasped by a single hand of a user compressed toward each other. Since the member 10 is resilient, the portion 20 acts like a coil spring. The leg portions 30 and 32 resist the compressive force and will return to their original angular disposition when released if not clasped together.

The first leg portion 30 has a generally straight first part 34 extending from the intermediate portion 20 and a curved second part 36 which extends from the first part 34 and turns away from the second leg portion 32. The second leg portion 32 has a generally straight first component 38 extending from the intermediate portion 20, a generally straight second component 40 extending from the first component 38 toward the first leg portion 30, and a third component 42 configured to provide a hook at the end of the second leg portion 32 remote from the intermediate portion 20. The first component 38 and the second component 40 define a generally L-shaped configuration.

Figure 2:
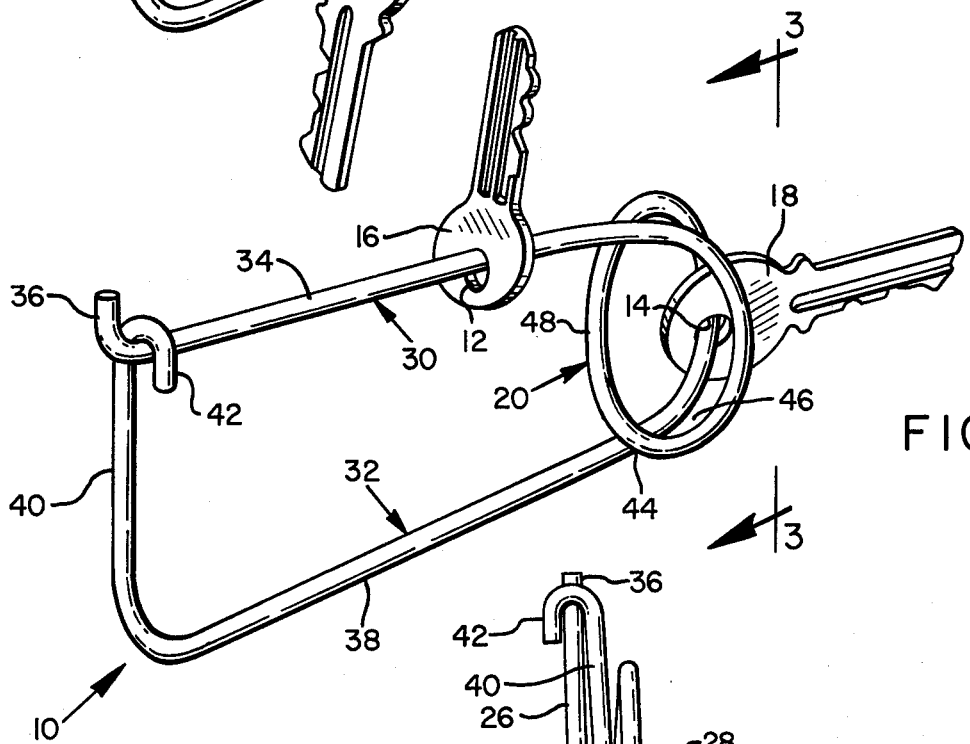
FIG. 2 shows the key holder of FIG. 1 in its clasped state with one of the keys moved to one of the overlying sections of the intermediate portion.

The hook provided by the third component 42 of the second leg portion 32 is sized, shaped and positioned to receive the curved second part 36 of the first leg portion 30 so that the leg portions can be compressed toward each other and engaged at their ends remote from the intermediate portion 20, as shown in FIG. 2. This prevents the leg portions from returning to their original angular disposition and prevents the keys 16 and 18 from sliding off of the member 10.

The acute angle between the leg portions 30 and 32 when the key holder is in its unclasped state should be made sufficiently large so that when the key holder is in its clasped state the first leg portion 30 will press against the hook on the second leg portion 32 with sufficient force to prevent inadvertent unclasping of the two leg portions and a resultant accidental loss of keys. This angle may vary according to the resiliency of the member. Keys may be easily attached and detached by unclasping the leg portions and sliding the keys on or off the ends of the member 10.

Figure 3:
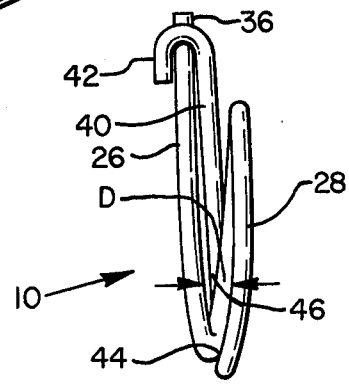
FIG. 3 shows an elevational end view of the key holder of FIG. 2 taken along line 3—3 of FIG. 2.

Referring to FIGS. 2 and 3, the overlying sections 26 and 28 of the intermediate portion 20 contact each other at a point 44 adjacent the second leg portion 32 and diverge from each other toward the first leg portion 30, so that they are spaced apart a distance greater than the maximum distance D over a majority of their lengths. That is, at a point 46 and thereafter, the overlying sections 26 and 28 are spaced apart a distance greater than the distance D.

A single key such as the key 14 can be manually slid along the second leg portion 32 past the point 44 and toward the first leg portion 30 by forcing the sections 26 and 28 to separate a distance greater than the distance D. Because the member 10 is resilient, the overlying sections will move back into contact at the point 44 after key 14 has been slid past the point 46. Thereafter, the key 14 can slide relatively freely along the overlying section 28 and along the intermediate portion 20 to a position close to the point of contact 44. In order to slide onto the overlying section 26 and thence onto the first leg portion 30, the key 14 must be forced past the point 44 a second time.

Sliding of the key 14 from the segment 48 of the intermediate portion 20 starting and ending at the point 44 is substantially inhibited without manual aid since the overlying sections 26 and 28 must be forced apart. Keys can be separated into three separate groups, one group on the segment 48 and one group on each of the leg portions 30 and 32. A single key may be isolated on the segment 48.

The overlying sections 26 and 28 need not contact each other at the point 44. It is necessary only that the distance between the sections at the point 44 be less than the minimum distance d, so that the sections must be forced apart in order for any of the keys to pass the point.

The key 14 can slide freely on either of the overlying sections 26 and 28 over a majority of their lengths, i.e., from point 46 toward the first leg portion 30. When the key 14 is isolated on either of the overlying sections 26 and 28, the key holder can be grasped with the coiled intermediate portion 20 projecting forwardly and the key 14 will be in a convenient position for locking or unlocking.

It will be understood that modifications and adaptations of the preferred embodiment will occur to those skilled in the art. For example, the leg portions can be made in various shapes and the clasping means may be formed by configuring the ends of the member in any suitable fashion. Clasping means separate and distinct from the member 10 may also be used. The intermediate portion may be coiled through as many revolutions as desired. The spacing between the overlying sections may be adjusted according to the dimensions of the keys which are to be held on the key holder. Such modifications and adaptations are within the spirit and scope of the present invention.

What is claimed is:

1. A key holder comprising an elongate, resilient member adapted to receive a plurality of keys thereon, which keys have respective member receiving apertures in their heads spaced from the peripheries of the heads a predetermined minimum distance and a predetermined maximum distance;

said member being configured to provide an intermediate portion which is coiled so as to have adjacent sections;

said adjacent sections being spaced apart a distance less than said minimum distance at a point and diverging from each other from said point so that they are spaced apart a distance greater than said maximum distance over a majority of their lengths;

whereby a single one of said plurality of keys can be isolated on a segment of said intermediate portion, sliding of said one key from said segment is substantially inhibited without manual aid, and said one key can slide relatively freely on said sections over a majority of their lengths.

2. A key holder according to claim 1 wherein said member is configured to provide first and second leg portions which extend outwardly from said intermediate portion and means for releasably joining said leg portions at their ends remote from said intermediate portion to prevent said keys from sliding off of said member.

3. A key holder according to claim 2 wherein:

said first leg portion has a generally straight first part extending from said intermediate portion, and a curved second part extending from said first part and turning away from said second leg portion;

said second leg portion has a generally straight first component extending from said intermediate portion, a generally straight second component extending from said first component toward said first leg portion so that said first and second components define a generally L-shaped configuration, and a third component configured to provide a hook at the end of the second leg portion remote from said intermediate portion; and said hook adapted to receive said curved second part of said first leg portion so that said leg portions can be compressed toward each other and said second part engaged with said hook to prevent said leg portions from returning to their original angular disposition and to prevent said keys from sliding off of said member.

4. A key holder comprising an elongate, resilient member adapted to receive thereon a plurality of keys, which keys have respective member receiving apertures in their heads spaced from the peripheries of the heads a predetermined minimum distance and a predetermined maximum distance;

said member being configured to provide an intermediate portion and first and second leg portions each extending outwardly from said intermediate portion;

said intermediate portion being coiled so as to have adjacent sections;

said first and second leg portions being angularly disposed relative to each other at an acute angle which is sufficiently small so that said first and second leg portions can be readily grasped by a single hand of a user and compressed toward each other;

the ends of said first and second leg portions remote from said intermediate portion being configured to provide means for releasably clasping said leg portions together to prevent them from returning to their original angular disposition and to prevent said keys from sliding off of said member; and said adjacent sections of said intermediate portion being spaced apart a distance less than said minimum distance adjacent said second leg portion and diverging from each other toward said first leg portion so that they are spaced apart a distance greater than said maximum distance over a majority of their lengths, whereby a single one of said plurality of keys can be isolated on a segment of said intermediate portion, sliding of said one key from said segment is substantially inhibited without manual aid, and said one key can slide relatively freely on said sections over a majority of their lengths.

5. A key holder according to claim 4 wherein said intermediate portion is coiled through more than one and one-quarter revolutions but less than one and one-half revolutions.

6. A key holder according to claim 4 wherein the elongate member has a round cross section.

7. A key holder according to claim 4 wherein:

said first leg portion has a generally straight first part extending from said intermediate portion, and a curved second part extending from said first part and turning away from said second leg portion;

said second leg portion has a generally straight first component extending from said intermediate portion, a generally straight second component extending from said first component toward said first leg portion so that said first and second component define a generally L-shaped configuration, and a third component configured to provide a hook at the end of the second leg portion remote from said intermediate portion; and said hook adapted to receive said curved second part of said first leg portion so that said leg portions can be compressed toward each other and said second part engaged with said hook to prevent said leg portions from returning to their original angular disposition and to prevent said keys from sliding off of said member.

8. A key holder according to claim 4 wherein said adjacent sections of said coiled intermediate portion overlie each other along their entire lengths.

9. A key holder according to claim 4 wherein said adjacent sections of said coiled intermediate portion contact each other adjacent said second leg portion and diverge from each other toward said first leg portion.

10. A key holder comprising an elongate, resilient member adapted to receive thereon a plurality of keys, which keys have respective member receiving apertures in their heads spaced from the peripheries of the heads a predetermined maximum distance;

said member being configured to provide an intermediate portion and first and second leg portions each extending outwardly from said intermediate portion;

said intermediate portion being coiled through more than one and one-quarter revolutions but less than one and one-half revolutions so as to have overlying sections;

said first and second leg portions being angularly disposed relative to each other at an acute angle which is sufficiently small so that said first and second leg portions can be readily grasped by a single hand of a user and compressed toward each other;

said first leg portion having a generally straight first part extending from said intermediate portion, and a curved second part extending from said first part and turning away from said second leg portion;

said second leg portion having a generally straight first component extending from said intermediate portion, a generally straight second component extending from said first component toward said first leg portion so that said first and second components define a generally L-shaped configuration, and a third component configured to provide a hook at the end of the second leg portion remote from said intermediate portion;

said hook adapted to receive said curved second part of said first leg portion so that said leg portions can be compressed toward each other and said curved second part engaged with said hook to prevent said leg portions from returning to their original angular disposition and to prevent said keys from sliding off of said member; and said overlying sections of said intermediate portion contacting each other adjacent said second leg portion and diverging from each other toward said first leg portion so that they are spaced apart a distance greater than said maximum distance over a majority of their lengths, whereby a single one of said plurality of keys can be isolated on a segment of the intermediate portion, sliding of said one key from said segment is substantially inhibited without manual aid, and said one key can slide relatively freely on said overlying sections over a majority of their lengths.

* * * * *